US005842328A

United States Patent [19]

Kinoshita

[11] Patent Number: 5,842,328

[45] Date of Patent: Dec. 1, 1998

[54] APPARATUS AND METHOD FOR FORMING A CONTAINER

[75] Inventor: Shigehiro Kinoshita, Kanagawa, Japan

[73] Assignee: Tetra Laval Holdings & Finance, SA, Pully, Switzerland

[21] Appl. No.: 914,500

[22] Filed: Aug. 19, 1997

[51] Int. Cl.[6] ..... B65B 43/26

[52] U.S. Cl. ..... 53/565; 53/457; 53/458; 53/484; 53/376.4; 53/376.3; 493/184

[58] Field of Search ..... 53/457, 458, 565, 53/481, 484, 371.8, 370.7, 376.4, 493; 493/165, 184, 452, 133, 189, 310, 408

[56] References Cited

U.S. PATENT DOCUMENTS

| | | | |
|---|---|---|---|
| 1,991,223 | 2/1935 | Ledig | 53/564 |
| 2,360,435 | 10/1944 | Martin | 493/452 |
| 3,002,328 | 10/1961 | Monroe | 53/370.8 |
| 3,058,271 | 10/1962 | McGihon . | |
| 3,212,413 | 10/1965 | Allen | 493/163 |
| 3,249,025 | 5/1966 | Monroe | 493/184 |
| 3,394,636 | 7/1968 | Vadas | 493/465 |
| 3,403,606 | 10/1968 | Gartin | 493/184 |
| 3,476,023 | 11/1969 | Fuller et al. . | |
| 3,613,527 | 10/1971 | Hentges et al. . | |
| 3,699,743 | 10/1972 | King | 53/565 |
| 4,127,977 | 12/1978 | Roehn . | |
| 4,603,535 | 8/1986 | Schultheis | 53/373 |
| 4,685,275 | 8/1987 | Nigrelli | 53/458 |
| 4,976,677 | 12/1990 | Siversson . | |
| 5,027,586 | 7/1991 | Ramaker | 53/458 |
| 5,194,065 | 3/1993 | Risko et al. . | |
| 5,321,936 | 6/1994 | Sendldorfer . | |
| 5,531,661 | 7/1996 | Moncrief | 493/313 |
| 5,605,030 | 2/1997 | Rodocker | 53/484 |

*Primary Examiner*—Daniel B. Moon
*Assistant Examiner*—James P. Calve
*Attorney, Agent, or Firm*—Michael A. Catania

[57] ABSTRACT

The combination of a carrier for a container, a squaring plate, a drive for the squaring plate, and a sealing assembly. The carrier accepts a container having first and second spaced flat walls that are substantially parallel to each other with the container in an erected state and third and fourth walls each connecting between the first and second flat walls. The carrier has a first edge against which the first wall of the container can be abutted so that the first wall is thereby supported in a first orientation with the container operatively held by the carrier. The squaring plate is guided in movement relative to the carrier towards the first edge. The squaring plate has a guide edge for engaging the second wall of the container operatively held by the carrier as the guide edge moves relative to the carrier towards the first edge and thereby repositioning the second wall relative to the first wall as an incident of which the first wall is urged toward the first orientation and the first and second walls are urged into substantially parallel relationship with each other. The sealing assembly has a sealer element that is guidingly advanced towards and against a part of the container operatively held by the carrier to thereby reconfigure and close the part of the container operatively held by the carrier.

2 Claims, 5 Drawing Sheets

APPARATUS AND METHOD FOR FORMING A CONTAINER

FIELD OF THE INVENTION

This invention relates to containers and, more particularly, to a container that is erected from a foldable blank.

BACKGROUND ART

It is known to construct containers, as for edible products, from a paperboard blank. The blank is stamped from stock material and has fold lines formed thereon which facilitate folding of the blank in a predetermined fashion to erect the container. Typically, the initial forming steps involve folding the blank to produce a sleeve shape which has a square or rectangular opening bounded by first and second flat, facing wall pairs. The edges of the blank are bonded to maintain the sleeve shape.

Commonly, the containers are formed on assembly lines using carriers to transport the containers to different stations for the serial performance of different operations thereon. The blank, in the sleeve shape, may be placed in a carrier which in one form has a U shape in cross section to grip the sleeve. The carrier is designed to simultaneously engage at least three of the container walls, thereby maintaining the container in a generally squared and open state.

To facilitate introduction of the sleeve into the carrier and removal of the completed container from the carrier, the carrier is configured to relatively loosely accept the container as a consequence of which the container may assume an out-of-square shape while it is operably held by the carrier. Since contiguous wall portions may not be relatively folded to be shape-retentive in an orthogonal relationship before the container is introduced to the carrier, the memory of the paperboard material may cause the container to tend towards a diamond shape with the container operably held by the carrier. This condition may affect the ultimate configuration of the container, as explained below.

The carrier commonly situates the container at a sealing station. At the sealing station, plates advance against parts of the walls of one parallel wall pair to urge the parts of the container walls against each other as an incident of which the walls of the other wall pair collapse, each in a generally V shape as dictated by the fold lines, between the parts of the one wall pair. With the container sleeve in a perfectly squared shape, the sealing operation just described will produce a symmetrical folding pattern. If the sealing step is carried out with the container assuming an out-of-square, diamond shape, the resulting folding pattern is nonsymmetrical. This may cause an undesired distortion of the completed container and, in a worst case, a compromise in the seal.

It is known to address the above problem by directing the container into a stationary jig which will square the container shape. This requires the repositioning of the container along the line of the sleeve opening axis. While use of the jig may result in a more square configuration, it requires additional manipulation of the container. That is, the container must be directed into the jig after it is advanced via the carrier to the station having the jig and retracted therefrom before the container can be advanced to the next station.

SUMMARY OF THE INVENTION

In one form, the invention is directed to the combination of a carrier for a container, a squaring plate, a drive for the squaring plate, and a sealing assembly. The carrier accepts a container having first and second spaced flat walls that are substantially parallel to each other with the container in an erected state and third and fourth walls each connecting between the first and second flat walls. The carrier has a first edge against which the first wall of the container can be abutted so that the first wall is thereby supported in a first orientation with the container operatively held by the carrier. The squaring plate is guided in movement relative to the carrier towards the first edge. The squaring plate has a guide edge for engaging the second wall of the container operatively held by the carrier as the guide edge moves relative to the carrier towards the first edge and thereby repositioning the second wall relative to the first wall as an incident of which the first wall is urged toward the first orientation and the first and second walls are urged into substantially parallel relationship with each other. The sealing assembly has a sealer element that is guidingly advanced towards and against a part of the container operatively held by the carrier to thereby reconfigure and close the part of the container operatively held by the carrier.

The third and fourth walls of the container may be flat and substantially parallel to each other with the container in the erected state. The third and fourth walls may each connect either directly or indirectly between the first and second walls.

In one form, the sealer element is movable in a first path in a first direction to close the part of the container held by the carrier. The sealer element and squaring plate are operatively interconnected so that the squaring plate is movable towards the first edge as an incident of the sealer element moving in the first direction in the first path.

The sealer element and squaring plate may be movable as one piece as the sealer element moves in the first direction in the first path.

In one form, with the container operatively held by the carrier, the first wall in the first orientation is substantially parallel to a reference plane. The squaring plate moves in a second path in a first direction towards the first edge. The second path may be non-orthogonal to the reference plane.

In one form, the first path is substantially straight and orthogonal to the reference plane.

The guide edge on the squaring plate may be substantially straight and parallel to the reference plane and may fully span the second wall of a container operatively held by the carrier.

The squaring plate may have a second edge for engaging one of the third and fourth walls of a container operatively held by the carrier as the squaring plate is moved in the second path in the first direction.

The second edge may be defined by a pin projecting from the guide edge.

The invention also contemplates the combination of a container, carrier, squaring plate, a drive for the squaring plate, and a sealing assembly wherein the container is formed from a foldable blank and has first and second spaced flat walls that are substantially parallel to each other with the container in an erected state and third and fourth spaced walls that are substantially parallel to each other with the container in the erected state and each connecting between the first and second walls. The carrier has a receptacle for the container which is bounded by a first edge against which the first wall of the container is abutted with the first wall in a first orientation with the container operatively held by the carrier. The squaring plate is guided in movement relative to the carrier towards the first edge. The squaring plate has a guide edge for engaging the second wall of the container operatively held by the carrier as the guide edge moves relative to the carrier towards the first edge and thereby repositioning the second wall relative to the first wall as an incident of which the first wall is urged towards the first orientation and the first and second walls are urged into substantially parallel relationship with each other. The sealing assembly has a sealer element that is guidingly advanced towards and against the part of the container operatively held by the carrier.

The invention also contemplates a method of forming a container including the steps of: reconfiguring a blank into a container having first and second spaced flat walls that are substantially parallel to each other and third and fourth walls each connecting between the first and second walls; providing a carrier for the container which carrier has a receptacle bounded by a first edge; placing the container in the carrier receptacle so that the container is operatively held by the carrier with the first wall of the container adjacent to the first edge; providing a squaring plate with a guide edge; advancing the guide edge against the second wall and thereby repositioning the second wall relative to the first wall as an incident of which the first wall is urged against the first edge and the second wall is urged into substantially parallel relationship with the first wall; providing a sealing assembly having a sealer element; and advancing the sealer element against one of the first and second walls of the container operatively held by the carrier and thereby reconfiguring and closing a part of the container operatively held by the carrier.

The guide edge and sealer element may be simultaneously advanced against the container at spaced locations on the container.

The method may further include the steps of advancing the carrier with the container operatively held by the carrier to a first station at which the guide edge and the sealer element are advanced against the container and after advancing the guide edge and sealer element against the container and closing the part of the container moving the carrier with the container operatively held by the carrier to a second station spaced from the first station at which a separate operation is performed on the container without repositioning the container relative to the carrier.

DETAILED DESCRIPTION OF THE DRAWINGS

Figure 1:
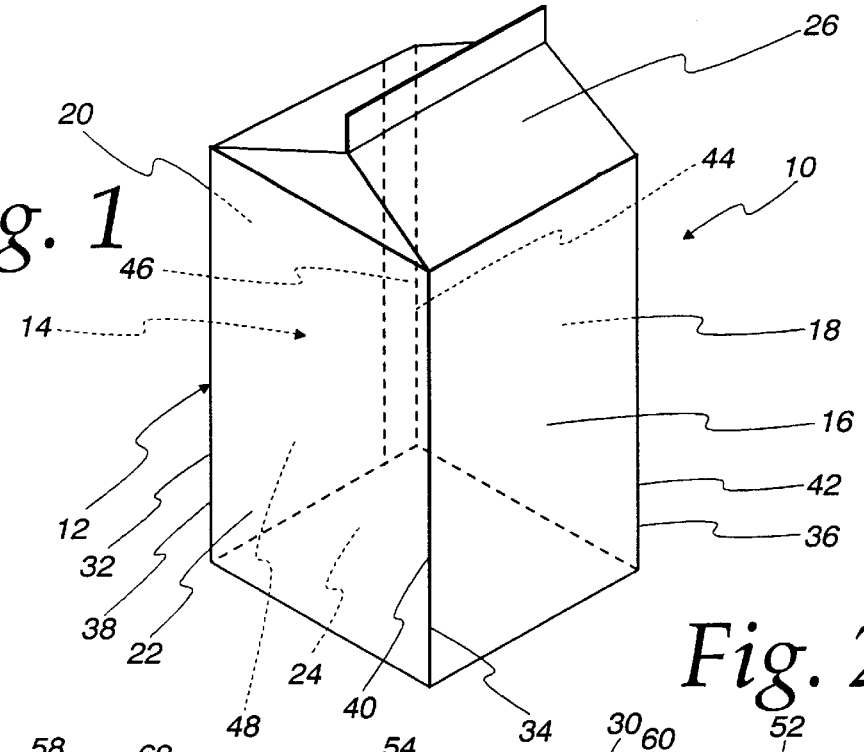
FIG. 1 is a perspective view of a completed container made according to the present invention.

In FIG. 1, an exemplary carton/container, formed according to the present invention, is shown at 10. The container 10 has a peripheral wall structure 12 bounding a material holding space 14. The peripheral wall structure 12 is defined by contiguous flat walls 16, 18, 20, and 22 with adjacent walls 16, 18, 20, and 22 being substantially perpendicular to each other so that the material holding space 14 is cubical in shape. The holding space 14 is bounded at the bottom of the container 10 by a folded bottom wall 24 and at the top of the container by a folded top wall 26. The container 10 can be used to hold virtually a limitless number of different materials, both edible and non-edible. The depicted form in FIG. 1 should not be viewed as limiting.

The container 10 is formed from a flexible, flat, paperboard blank 30 that may be coated with a thermoplastic material. The blank 30 can be conveniently die cut from stock material to the shape shown in FIG. 2. The blank 30 has fold lines formed therein in conventional fashion to facilitate reconfiguration of the blank 30 in a predetermined fashion as the container 10 is erected.

Figure 3:
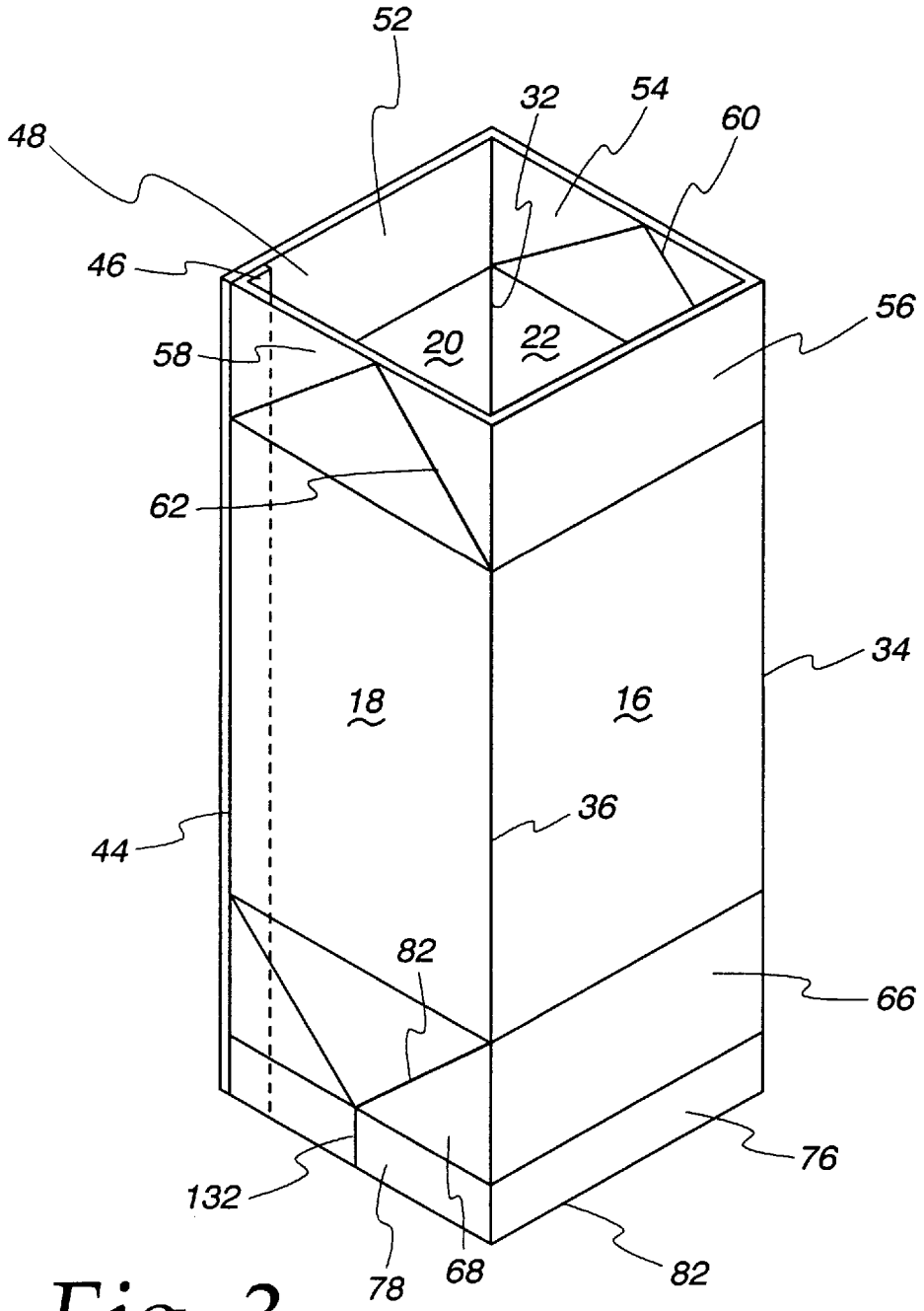
FIG. 3 is a perspective view of the blank in FIG. 2 erected to define a preliminary sleeve shape.

Parallel fold lines 32, 34, and 36 allow relative folding between the panels 20, 22; 22, 16; and 16, 18 to produce container corners 38, 40, and 42. A fold line 44, parallel to the fold lines 32, 34 and 36, separates a flap 46 which overlies the inside surface 48 of the wall 20 and is adhered thereto to maintain the blank 30 in the preliminary sleeve shape of FIG. 3.

The bottom of the blank 30 has a laterally extending fold line 50 which separates flaps 52, 54, 56 and 58 out of the walls 20, 22, 16, 18, which flaps 52, 54, 56 and 58 are foldable to define the bottom wall 24 of the container 10 in conventional fashion. The flaps 54, 58 have Y-shaped fold lines 60, 62 which allow collapsing of the flaps 54, 58 in a known manner to form the bottom wall 24.

A laterally extending fold line 60 separates flaps 62, 64, 66, 68 at the top of the walls 20, 22, 16, 18. A fold line 70, parallel to the fold line 60, in turn separates fins 72, 74, 76, 78 at the free ends of the flaps 62, 64, 66, 68. Y-shaped fold lines 80, 82 are provided in the flaps 64, 68 and extend to the top edge 82 of the blank 30.

As shown in FIGS. 4–7, carriers 84 are used to operatively hold the container 10 in the preliminary sleeve shape. Each carrier 84 has a general U-shaped cross section with a base 86 and legs 88, 90 projecting from the base 86. The base 86 has vertically extending ribs 92, 94 bounding a receptacle 96 for the container 10. The ribs 92, 94 each have an apex 98, 100 with the apexes 98, 100 cooperatively defining an edge which abuts to the container wall 20 with the container 10 operatively held by the carrier 84 and the wall 20 in a first orientation.

The leg 88 has like vertically extending ribs 102, 104 which simultaneously abut to the container wall 18 with the container wall 20 in the first orientation and the container wall 18 orthogonal thereto. The carrier leg 90 has like vertically extending ribs 106, 108 to simultaneously abut to the wall 22 with the wall 20 in the first orientation and the wall 22 orthogonal thereto.

Figure 4:
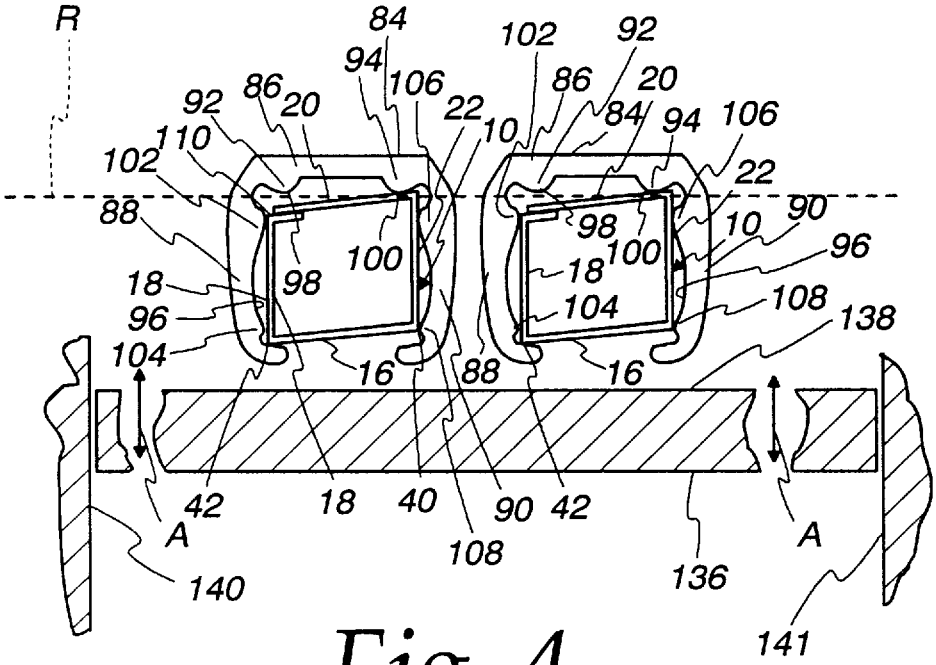
FIG. 4 is a plan view of a part of a sealing station, according to the present invention, with carriers each having a container sleeve operably held thereby and in relationship to a squaring plate being advanced towards the container sleeves.
Figure 5:
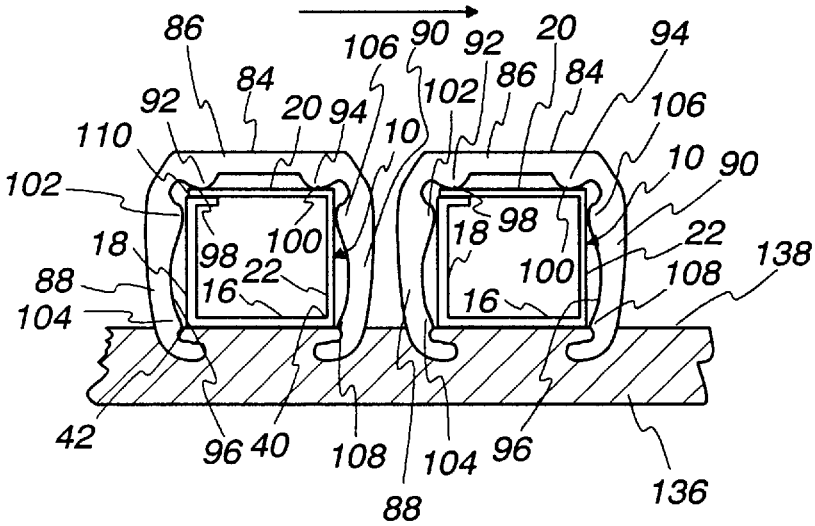
FIG. 5 is a view as in FIG. 4 with the squaring plate advanced against the container sleeves.
Figure 6:
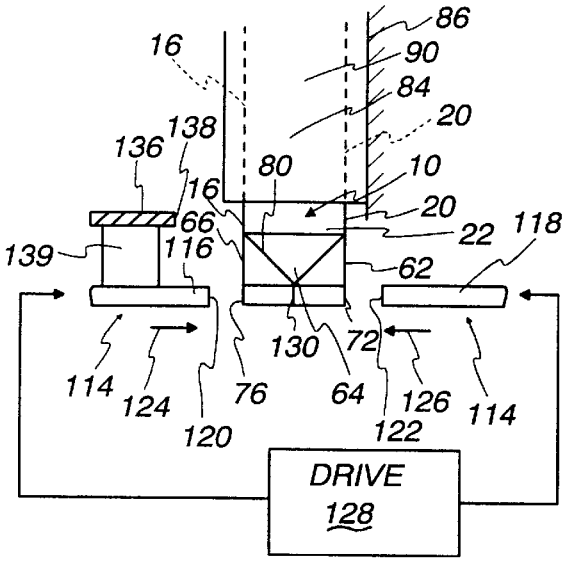
FIG. 6 is a side elevation view of the sealing station of FIGS. 4 and 5 having a sealing assembly for closing an end portion of the container sleeve and in a first state as sealing is initiated.
Figure 7:
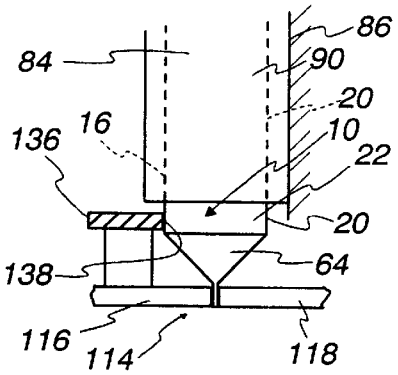
FIG. 7 is a view as in FIG. 6 with the sealing assembly in a second state wherein an end of the container sleeve is closed.
Figure 10:
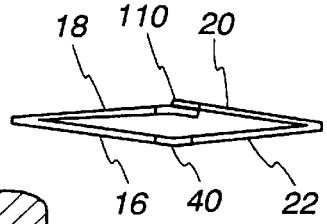
FIG. 10 is a plan view of the container sleeve in FIG. 3 in a relaxed state.

Generally, during the initial formation of the blank 30 into a sleeve shape, the corners 110, 40 at the juncture between the walls 18, 20 and 16, 22 respectively, are not pre-bent. As a consequence, the memory in the paperboard tends to place the container in a diamond shape, as shown in FIG. 10. By placing the container sleeve 10 into the carrier receptacle 96, the container 10 assumes a more squared shape, as shown in FIG. 4. However, the container 10 is loosely fit in the receptacle 96 and commonly retains a slightly diamond-shaped configuration.

With the container 10 operatively held by the carrier 84, the top of the container 10 is reconfigured by a sealing assembly at 114 at a sealing station. The sealing assembly 114 consists of spaced sealer elements 116, 118 which are guidingly advanced towards each other to reconfigure the container 10 and close the depending/top part of the container 10 which is operatively held by the carrier 84. The sealer element 116 has a straight edge 120 with the sealer element 118 having a corresponding, facing edge 122. As the sealer element 116 is advanced in the direction of the arrow 124 towards the container 10 operatively held by the carrier 84, the edge 120 initially contacts the container wall 16. The sealer element 118 moves oppositely in the direction of the arrow 126 to initially contact the container wall 20. The sealer elements 116, 118 are moved towards and away from the container 10 through a drive 128.

Figure 2:
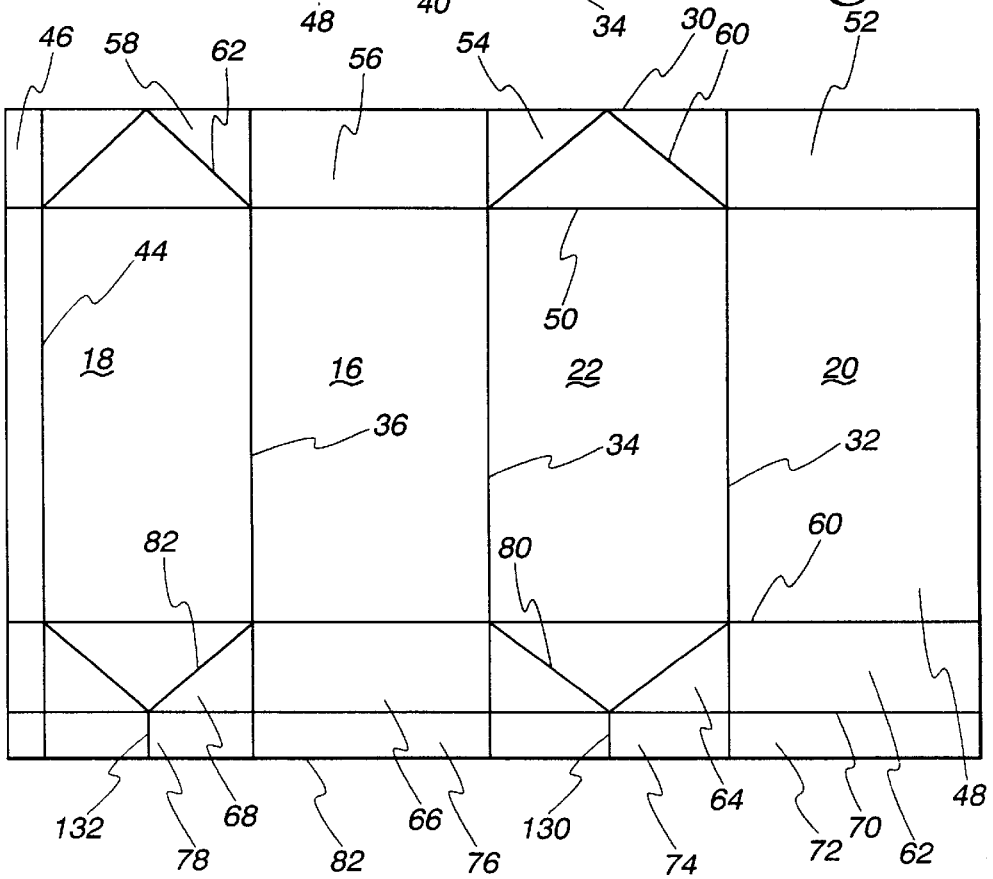
FIG. 2 is a plan view of a blank used to form the container of FIG. 1.

The edges 120, 122 are aligned to engage the walls 16, 20 at the flat fins 76, 72 on the flaps 66, 62, respectively. Progressive movement of the sealer elements 116, 118 causes the flaps 64, 68 to collapse inwardly as predetermined by the fold lines 80, 82. As this occurs, the fin 74 assumes an outwardly opening V-shape with a fold line portion 130 defining the apex of the V. The fin 78 folds in like fashion about a fold line portion 132 (FIG. 2). Eventually, the folded fins 74, 78 become closely captive between the fins 72, 76, with the fins 72, 74, 76, 78 being thereafter conventionally, thermally, or otherwise sealed, in this arrangement.

Figure 11:
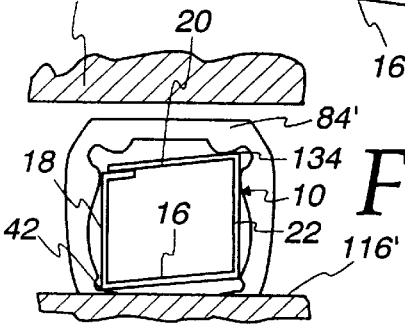
Fig. 11 (prior art)
FIG. 11 is a plan view of a part of a conventional sealing station and showing a carrier operably holding a container sleeve in preparation for a sealing operation.
Figure 12:
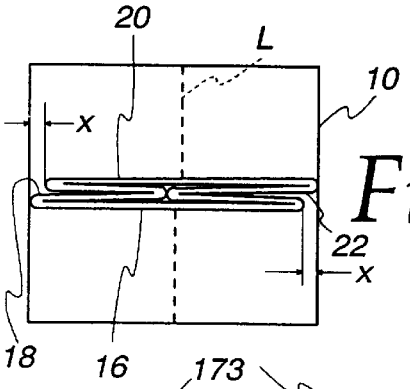
Fig. 12 (prior art)
FIG. 12 is an enlarged, plan view of a container formed at the sealing station in FIG. 11 and wherein the sealed portion of the container is distorted.

The problem with reconfiguring the container 10 to close the top thereof with the container 10 in a non-squared state is demonstrated in a representative prior art system in FIGS. 11 and 12, wherein parts corresponding to those in FIGS. 1–7 are designated with the same number plus a "'" designation. In FIG. 11, the container 10 is operatively held by a carrier 84' with the container 10 slightly out of square. By advancing the sealer elements 116', 118' towards each other, the sealer element 116' initially contacts the corner 42 between the walls 16, 18. The sealer element 118' initially contacts the corner 134 between the walls 20', 22'. The sealer elements 116', 118', rather than squaring the container 10, tend to effect reconfiguration thereof with the nonsquared shape of the container 10 maintained throughout the sealing process. The end result, as seen in FIG. 12, is that the walls 16, 20 do not match up i.e. the wall 16 is shifted in FIG. 12 to the left of a center line L by a distance X and the wall 20 is shifted to the right of the center line L by a distance X. The collapsed portions of the walls 18, 22 become distorted to accommodate this shifting. This may result in the overall completed shape of the container 10 becoming distorted. In a worst case, the seal at the container end may be compromised.

The above problem is obviated according to the invention by providing a squaring plate 136, as shown in FIGS. 4–7. The squaring plate 136 has a guide edge 138 which spans the width of the wall 16 and follows movement of the sealer element 116 against the container 10 in a direction towards the wall 20. A variety of arrangements may be devised wherein the squaring plate 136 moves towards the container 10 as an incident of the sealer element 116 moving towards the container 10. In a preferred form, the squaring plate 136 is supported on a base 139 above the sealer element 116 and moves as one piece with the sealer element 116. As this occurs, the sealer edge 120 initially contacts the container wall 16 and begins to effect reconfiguration thereof. Before the reconfiguration is completed, the guide edge 138 contacts the wall 16 and urges the wall 16 towards the wall 20 in such a fashion that the wall 20 assumes a first orientation against the edge defined cooperatively by the ribs 92, 94 and the walls 16, 18 are urged into substantially parallel relationship with each other. The guide edge 138 is substantially parallel to a reference plane R (FIG. 4) that is parallel to the edge defined cooperatively by the ribs 92, 94. The squaring plate 136 is guided by facing surfaces 140, 141 in the line of the double-headed arrows A (FIG. 4) towards and away from the container 10 in a straight path that is orthogonal to the reference plane R.

By movement of a single subassembly consisting of the sealer element 116 and the plate 138, squaring and reconfiguration of the container 10 are simultaneously carried out. This obviates the need for independently driven squaring and sealing structures, and the performance of separate operations upon the container 10.

Figure 8:
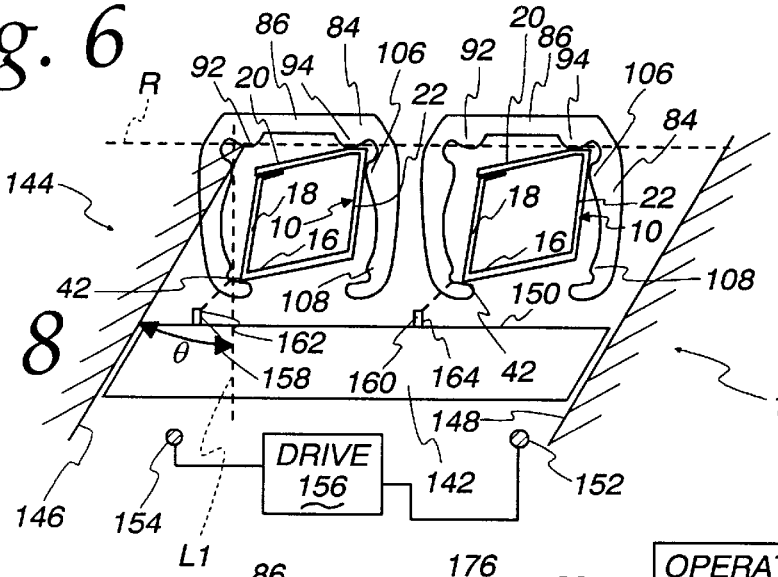
FIG. 8 is a view as in FIG. 4 and showing a modified form of squaring plate, according to present invention, being advanced towards the container sleeves.
Figure 9:
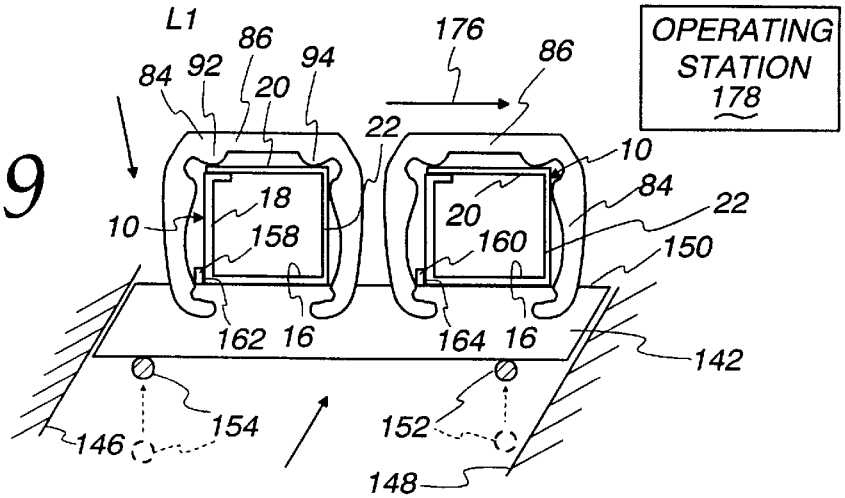
FIG. 9 is a view as in FIG. 5 and showing the squaring plate advanced against the container sleeves.

In FIGS. 8 and 9, a modified form of the invention is shown. The modification resides in the configuration of the squaring plate 142, corresponding to the squaring plate 136, and guide structure at 144 therefor. The guide structure 144 has facing guide surfaces 146, 148 which are parallel to each other and at an angle θ with respect to a line L1 perpendicular to the reference plane R. The squaring plate 142 has a guide edge 150 corresponding to the guide edge 138 on the plate 136, previously described, which edge 150 is parallel to the reference plane R. The plate 142 is shifted from the retracted FIG. 8 position to the FIG. 9 position by a pair of spaced pins 152, 154 which are advanced by a drive 156 in a linear path that is orthogonal to the reference plane R. As the pins 152, 154 encounter the plate 142, the plate 142 shifts from left to right relative to the pins 152, 154 as it approaches the containers 10 operatively held by the carriers 84.

The plate 142 has pins 158, 160 projecting from the guide edge 150. The pin 158 has an edge 162 to engage the container wall 18 as the edge 150 engages the container wall 16. The pin 160 has a like edge 164 to engage the container wall 18 on the container 10 operatively held by an adjacent carrier 84. The edges 150, 162 and 150, 164 define corners to accept the corner 42 of the container 10 between the walls 16, 18. This causes a squaring of the corner 42 as the corner 42 encounters the pins 158, 160. At the same time, the pins 158, 160 shift laterally with the angularly advancing squaring plate 142 so that the wall 20 is positively urged to its first orientation against the ribs 92, 94 on the base 86 of the carrier 84 while at the same time the wall 22 is urged laterally against the ribs 106, 108 on the leg 90 of the carrier 84. All four walls 16, 18, 20, 22 thereby become squared.

Figure 13:
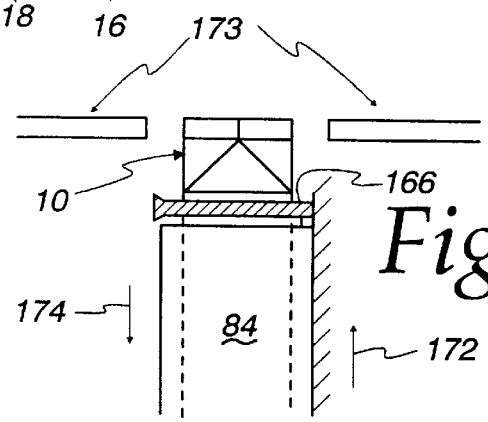
Fig. 13 (prior art)
FIG. 13 is a side elevation view of a part of a conventional sealing station with a container operably held by a carrier and with conventional stationary squaring bars engaging the container.
Figure 14:
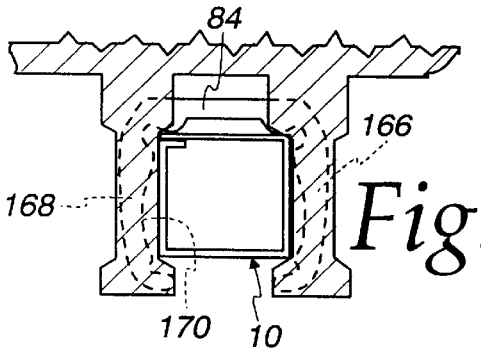
Fig. 14 (prior art)
FIG. 14 is a plan view of the sealing station in FIG. 13.

FIGS. 13 and 14 identify another problem area with the prior art systems. It is known to provide a pair of stationary, cantilevered, squaring bars 166, 168 between which a receptacle 170 is defined to tightly accept a container 10, in a squared configuration. This arrangement requires that the container 10 operatively held by the carrier 84 be advanced in the direction of the arrow 172 into the receptacle 170 to allow the container end portion to be closed by a sealing assembly 173 at a sealing station. Once the carrier 84 with the container 10 operatively held thereby is aligned underneath the receptacle 170, the container 10 must be directed upwardly between the bars 166, 168. After the end of the container 10 is closed, the container 10 must be retracted in the direction of the arrow 174 out of the receptacle 170 to be moved onwardly to a separate operating station without interference from the bars 166, 168.

On the other hand, the containers 10 operatively held by the carriers 84, in accordance with the present invention, can be closed at the sealing station and indexed in the direction of the arrow 176 (FIG. 9) from the sealing station to a separate operating station 178, for the performance of another operation, without repositioning the container 10 relative to the carrier 84 or the carrier 84 relatively to any of the sealing structure.

The foregoing disclosure of specific embodiments is intended to be illustrative of the broad concepts comprehended by the invention.

I claim:

1. A method for forming a gabled carton on a packaging machine, the method comprising:

erecting a carton from a blank, the carton having first and second spaced side walls that are substantially parallel to each other and third and fourth side walls each connecting between the first and second side walls, each of the sidewalls having a top portion, a center portion and a bottom portion, the carton having top and bottom walls, each top wall engaging a corresponding side wall at the top portion of side wall, each bottom portion engaging a corresponding side wall at the bottom portion of the side wall, the carton having a plurality of fin panels for forming a fin;

placing the erected carton into a U-shaped carrier, the U-shaped carrier having a base and first and second legs substantially perpendicular to the base, the base and legs forming an open end, the base and legs each having first and second vertically extending ribs, each rib having an apex for engaging the carton, the U-shaped carrier extending along the center portion of first, third and fourth side walls, the first side wall of the carton engaging the apexes of the vertically extending ribs of the base;

transporting the carton in the U-shaped carrier to a sealing assembly, the sealing assembly having first and second sealing elements, a base connected to the first sealing element and a squaring plate connected to the base, the squaring plate moving in conjunction with the first sealing element, the first sealing element having a length greater than the length of the squaring plate;

advancing the squaring plate and the first sealing element and the second sealing element toward the open end of the U-shaped carrier, the first sealing element engaging the carton prior to the squaring plate engaging the carton, the squaring plate contacting the second wall of the carton to square the carton;

sealing the plurality of fin panels together to form a fin of the gable top carton;

retracting the first sealing element and the squaring plate and the second sealing element from the carton and from the U-shaped carrier; and transporting the carton from the sealing assembly.

2. A packaging machine for forming a gabled carton having a plurality of side walls, a plurality of top walls and a plurality of bottom walls, the packaging machine comprising:

a plurality of U-shaped carton carriers attached to a means for conveyance, each of the U-shaped carriers having a base and first and second legs substantially perpendicular to the base, the base and legs forming an open end, the base and legs each having first and second vertically extending ribs, each rib having an apex for engaging the carton, each of the U-shaped carriers extending along a predetermined length equal or less than the length of the side walls of the carton; and a sealing assembly for sealing the walls of the carton, the sealing assembly disposed along the conveyor means, the sealing assembly having first and second sealing elements, a base connected to the first sealing element and a squaring plate connected to the base, the squaring plate moving in conjunction with the first sealing element, the first sealing element having a length greater than the length of the squaring plate.

* * * * *